United States Patent [19]

Larmit

[11] 4,096,889

[45] Jun. 27, 1978

[54] WEAVING LOOM

[75] Inventor: Adrianus Johannes Franciscus Larmit, Moergestel, Netherlands

[73] Assignee: Ruti-te Strake B.V., Deurne, Netherlands

[21] Appl. No.: 757,234

[22] Filed: Jan. 6, 1977

[30] Foreign Application Priority Data

May 31, 1976 Netherlands ..... 7605882

[51] Int. Cl.[2] ..... D03D 47/28

[52] U.S. Cl. ..... 139/435; 139/194

[58] Field of Search ..... 139/194, 370.2, 435

[56] References Cited

U.S. PATENT DOCUMENTS

| | | | |
|---|---|---|---|
| 3,744,533 | 7/1973 | Yano | 139/194 |
| 3,880,194 | 4/1975 | Vermeulen | 139/435 |

FOREIGN PATENT DOCUMENTS

| | | | |
|---|---|---|---|
| 42,075 | 7/1965 | Japan | 139/435 |

*Primary Examiner*—Henry S. Jaudon

*Attorney, Agent, or Firm*—Marshall & Yeasting

[57] ABSTRACT

A loom comprising two sheets of warp threads which are momentarily held in diverging planes to form a weaving shed with a conveying tunnel for wefts, a blowing nozzle arranged in position at one side of such shed to propel wefts through such shed by means of a fluid discharged from said nozzle, and a main tensioning device arranged in position at the other side of such shed, operating with a fluid jet, to tension inserted wefts during the beating up movement of the loom. The jet is so arranged that it issues substantially, transversely, and freely across the conveying tunnel to suck in the weft and is caught by a passage disposed in alignment with said jet. An auxiliary tensioning device is provided and is constructed similarly to the main tensioning device. The auxiliary device is disposed at the side of the main device. The main and auxiliary devices are used for normal and startup operations, respectively, and each has gas or air pressure supply means for normal or startup operation.

5 Claims, 2 Drawing Figures

WEAVING LOOM

Figure 1:
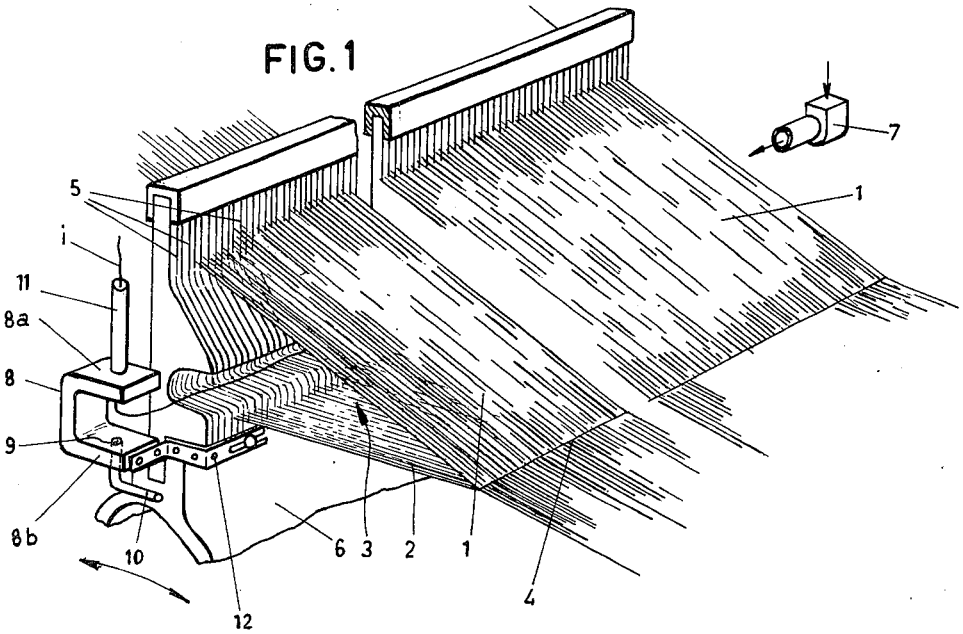

The present invention relates to a weaving machine of the type in which the reed is provided with a weft-inserting tunnel, which is confined by substantially U-shaped reed blades and in which the wefts are inserted through said tunnel from one side of the weaving shed to the other by means of a fluid jet delivered by a main nozzle disposed on said one side of the weaving shed. On the other side of the weaving shed a device is provided for tensioning an inserted weft and keeping said weft tensioned during the beating up movement of the reed, which device is operated by a jet of gas or air.

In a well-known loom of this type, the device for tensioning an inserted weft is formed by an injector-type nozzle, comprising an inlet section having a catching passage for the inserted weft in alignment with the cross-sectional area of the weft-inserting passage, a mixing tube disposed in alignment with said catching passage and a supply for the gas or air jet merging into the throat area between said mixing tube and said catching passage. Such pneumatic tensioning devices have advantages as compared with tensioning devices of a mechanical nature. The tensioning effect, however, of the prior pneumatic tensioning devices is limited in view of the fact that the major part of the weft-inserting air from the weft inserting passage has to be consumed by these devices.

According to the present invention; this drawback has been removed due to the fact that the supply for the gas or air jet is arranged relative to an imaginary cylinder disposed in alignment with the weft inserting passage in such a way that the jet flows substantially diametrically and freely across the cross-sectional area of said cylinder and is caught by a passage disposed substantially in alignment with said jet and emanating substantially from the circumferential surface of said imaginary cylinder.

In this way, the path of the inserted weft is crossed by a concentrated air jet at the end of the weft-inserting passage. The suction exerted by said air jet on the leading end of the inserted weft forces said weft to enter into said catching passage within which the concentrated air column moving with a high velocity exerts an effective tensioning force on said weft. Tests have shown that in this way the tension in the wefts and consequently the appearance of the cloth can be controlled by selecting a higher or lower pressure and/or selecting a longer or shorter mixing passage.

In the tensioning device according to the present invention, the action of the tensioning air jet is not influenced by the weft-inserting air quantities in the weft-inserting passage, as these air quantities are permitted to discharge freely at the end of the weft-inserting passage instead of having to be discharged through the mixing passage.

In a preferred embodiment, the air pressure supply of the tensioning device merges into one leg of a substantially U-shaped auxiliary element which is disposed in alignment with the weft-inserting tunnel confined by the U-shaped reed blades. A mixing passage or tensioning passage is connected to an opening in the second leg of said element. The opening in the second leg is disposed opposite to and in alignment with the supply opening.

Further characteristics of the present invention will be hereinafter further described with reference to the accompanying drawing showing a preferred embodiment.

Figure 2:
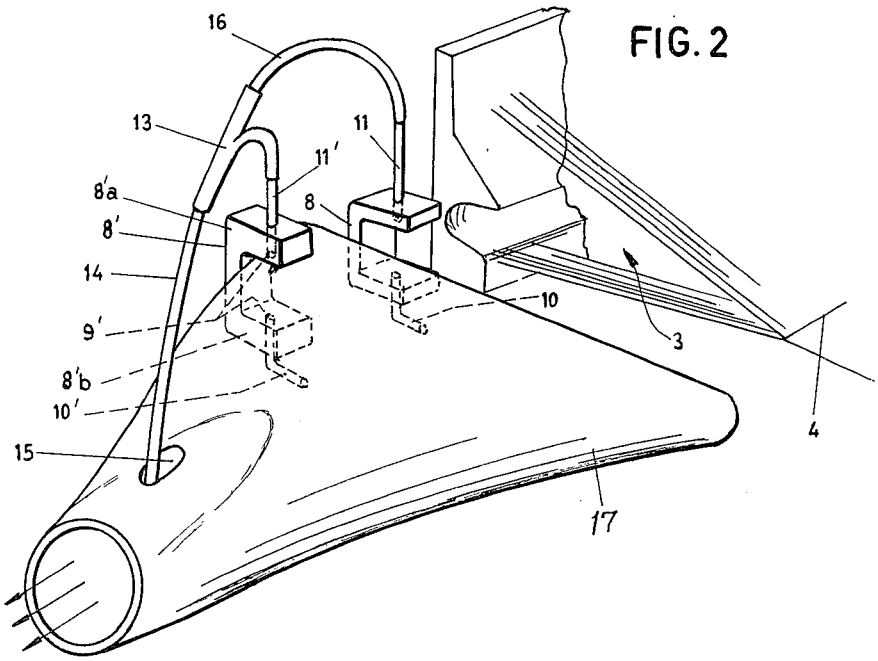

In the drawing:

FIG. 1 shows a perspective view of a part of the reed of a pneumatic weaving loom, provided with a tensioning device according to the present invention and FIG. 2 shows the tensioning device of FIG. 1, in combination with a suction nozzle for discharging the weft end portions which are to be cut off after weft insertion.

In the embodiment shown in the drawing, the upper and lower diverging warp sheets 1 and 2 form the weaving shed 3 within which a tunnel-like passage is completed by the substantially U-shaped reed blades 5 which are mounted in the lay beam 6 and have their openings facing towards the beating up line 4.

In the drawing the reed, comprising the lay beam 6 and the reed blades 5, is in its retracted position. In this position the passage formed by the reed blades 5 is in alignment with the weft inserting nozzle 7, said nozzle 7, being adapted to propel a weft through the said passage by means of an air jet. The tensioning device 8 is mounted on the side of the weaving loom away from the weft inserting nozzle 7. The tensioning device 8 comprises a U-shaped auxiliary element positioned in alignment with the weft-inserting passage and has its opening facing the beating up line 4. In each of the legs **8*a* and 8*b*, respectively, of the U-shaped auxiliary element 8 an air passage opening is provided. These openings are located one in alignment with the other, in such a way, that their common axis substantially diametrically crosses the space defined by the auxiliary element and is positioned in alignment with the weft-inserting passage. The lower air passage opening 9, which may have a cross-section of less than 1 $mm^2$, is connected to a supply 10 for air pressure, while the opening in the upper leg 8*a* is connected to a mixing or tensioning tube 11**. The inserted weft is indicated as *i*. The leading end of said weft is grasped by the air jet moving through the space between the legs **8*a* and 8*b* and is introduced into the tube 11**.

The tensioning device 8 is fixed to the reed by means of a bracket 12.

It will be understood that, when the reed has carried out its beating up movement and has returned to its retracted position shown in the drawing, the weft will be left in its position beaten up into the cloth. In normal operation — when accurately measured weft lengths are inserted one after the other — the weft end portion extending beyond the cloth will be pulled out from the tensioning tube 11. This projecting weft end portion is then cut off in a well-known manner and sucked off through a suction nozzle 7 (see FIG. 2).

The situation is different, however, at the startup of the weaving loom, e.g., when the weaving loom is restarted after a weaving defect. In such a situation, the first weft thread to be inserted upon restarting the loom has a length which is substantially longer than the weft thread measured during normal use. Usually the length of such a first weft thread is measured by hand. It will be understood that this might lead to a situation in which the leading end portion of the first weft thread would not be completely pulled out of the tensioning tube 11 with the heating up movement of the reed. This might even lead to a situation in which the leading end portion left in the tensioning tube would block the tensioning device for the next weft thread to be inserted. In order to avoid this, an auxiliary tensioning device 8' is provided which may take the role of the tensioning device 8 in situations as just referred to. This auxiliary tensioning device 8', which is shown in FIG. 2, is similar to the main tensioning device 8. It also comprises a substantially U-shaped element, which embraces a side wall portion of the suction nozzle 7. The legs 8*a'* and 8*b'* of said element bear on the upper and lower wall respectively of the suction nozzle 7, there being aligned openings in said upper and lower walls coinciding with openings 9' (similar to the openings 9 with the tensioning device 8) in the legs 8*a, b* of the tensioning device 8'. Air supply 10' and a mixing or tensioning tube 11' correspond to the air supply 10 and tensioning tube 11 of the main tensioning device. The auxiliary tensioning device 8' is positioned so that it is in alignment with the main tensioning device 8 when the latter (with the reed) is in its retracted position shown in the drawing. The suction nozzle 7 and the auxiliary tensioning device 8' are in a fixed position relative to the frame of the weaving loom.

Under startup conditions, i.e. during the first weft insertion, air pressure is supplied through the supply 10' rather than through the supply 10 of the main tensioning device, so that the leading end portion of the first weft thread is introduced in the tensioning tube 11'. As mentioned above, the leading end portion will remain within said tensioning tube 11' even when the weft thread is beaten up into the cloth. After the first weft thread is beaten up into the cloth the weaving loom is considered to be under normal operational condition and the main tensioning device 8, which will now be in operation, is prepared to take up the leading end of the second weft thread, which is measured to the normal length.

The tensioning tube 11' is connected through a connecting piece 13 to a discharge conduit 14, the outlet end of which merges into an opening 15 in the upper wall of the suction nozzle 7. The weft end portion of the first thread left within the tensioning tube 11' is discharged through said conduit 14 after this end portion is cut at some time during the continuing weaving process.

FIG. 2 also shows that the tensioning tube 11 is connected, by a flexible hose 16, with the substantially T-shaped connecting piece 13. By said hose 16 any fluffs may be sucked off from the area adjacent the main tensioning device 8, which prevents the main tensioning device from being blocked by such fluffs and ensures a continuously proper operation.

I claim:

1. A loom comprising two sheets of warp threads which are momentarily held in diverging planes to form a weaving shed with a conveying tunnel for wefts, a blowing nozzle arranged in position at one side of such shed to propel wefts through such shed by means of a fluid discharged from said nozzle, and a main tensioning device arranged in position at the other side of such shed, operating with a fluid jet, to tension inserted wefts during the heating up movement of the loom, wherein the improvement comprises so arranging the jet that the jet issues substantially, transversely, and freely across the conveying tunnel to suck in the weft and is caught by a passage disposed in alignment with said jet, and an auxiliary tensioning device similar to the main tensioning device is provided at the main tensioning device, the main and auxiliary tensioning devices being used for normal and startup operations, respectively, and each having fluid pressure supply means for normal or startup operation.

2. A loom according to claim 1 wherein each of the tensioning devices includes a substantially U-shaped piece, said fluid pressure supply means opening into one leg of the U-shaped piece and the other leg of the U-shaped piece having an aperture aligned with the opening of the fluid pressure supply means, and a tensioning passage joining said aperture.

3. A loom according to claim 2 having a stationary suction nozzle for cutoff weft end portions and wherein the U-shaped piece of the auxiliary tensioning device is fixed to and engages around a side edge of the suction nozzle, there being apertures provided in opposite walls of said suction nozzle aligned with the respective opening and aperture of the U-shaped piece.

4. A loom according to claim 3 wherein the tensioning passage of the auxiliary tensioning device is operatively connected to an aperture in the suction nozzle.

5. A loom according to claim 4 wherein the tensioning passage of the main tensioning device also is operatively connected to the suction nozzle.

* * * * *